US006047488A

United States Patent [19]

Tuszkiewicz

[11] Patent Number: 6,047,488

[45] Date of Patent: Apr. 11, 2000

[54] PEEL OUT PORTIONS INCORPORATED IN PAPER LABELS

[75] Inventor: George A. Tuszkiewicz, Plymouth, Minn.

[73] Assignee: General Mills, Inc., Minneapolis, Minn.

[21] Appl. No.: 08/967,643

[22] Filed: Nov. 10, 1997

[51] Int. Cl.[7] ..... B42D 15/00; G09F 3/00

[52] U.S. Cl. ..... 40/306; 40/310; 40/312; 206/831; 283/81; 283/105

[58] Field of Search ..... 40/306, 310, 312, 40/630, 672, 674; 283/81, 100, 101, 105; 206/831; 383/127

[56] References Cited

U.S. PATENT DOCUMENTS

| | | | |
|---|---|---|---|
| 3,958,744 | 5/1976 | Herglotz | 206/831 X |
| 3,994,089 | 11/1976 | Schwartz . | |
| 4,171,085 | 10/1979 | Doty . | |
| 4,306,367 | 12/1981 | Otto | 40/312 |
| 4,308,679 | 1/1982 | Ray, III et al. . | |
| 4,324,058 | 4/1982 | Sherwick et al. | 40/310 |
| 4,345,393 | 8/1982 | Price et al. . | |
| 4,430,816 | 2/1984 | Seton et al. | 40/306 X |
| 4,498,581 | 2/1985 | Dutcher . | |
| 4,537,586 | 8/1985 | Gale et al. . | |
| 4,842,303 | 6/1989 | Molenda . | |
| 4,880,964 | 11/1989 | Donahue . | |
| 5,007,578 | 4/1991 | Simone . | |
| 5,078,273 | 1/1992 | Kuchenbecker . | |
| 5,098,131 | 3/1992 | Tucker . | |
| 5,100,180 | 3/1992 | Tucker . | |
| 5,141,254 | 8/1992 | Ring . | |
| 5,172,936 | 12/1992 | Sullivan et al. . | |
| 5,324,559 | 6/1994 | Brombacher . | |
| 5,484,167 | 1/1996 | Donaldson et al. . | |
| 5,727,819 | 3/1998 | Grosskopf et al. | 283/81 |

FOREIGN PATENT DOCUMENTS

| | | | |
|---|---|---|---|
| 2090809 | 7/1982 | United Kingdom | 40/310 |

OTHER PUBLICATIONS

Advertisement flyer from Seville Flexpack Corporation for peel away coupon, circa Sep. 1997.

*Primary Examiner*—Terry Lee Melius
*Assistant Examiner*—Robert G. Santos
*Attorney, Agent, or Firm*—John A. O'Toole; Everett G. Diederiks; Alan D. Kamrath

[57] ABSTRACT

A label (12) formed of a single thickness of paper for attachment to a cylindrical container (26) includes a peel out portion (10) incorporated therein. The peel out portion (10) is axially oriented and includes a bottom edge (32) and a wedge shaped top edge (36) which are continuously cut. The side edges (34) extending between the bottom and top edges (32, 36) include lower and upper portions (34*a*, 34*c*) which are continuously cut and include intermediate, perforated portions (34*b*). A perforated cut (38) extends across the top edge (36) to define a handle (40). The peel out portion (10) can be removed from the label (12) attached to the container (26) in a preferred form by pivoting the handle (40) about the perforated cut (38) and then by grasping and pulling the handle (40) in a direction generally parallel to the axis of the container (26) and the side edges (34) and toward the lower edge (16) of the label (12).

26 Claims, 3 Drawing Sheets

PEEL OUT PORTIONS INCORPORATED IN PAPER LABELS

BACKGROUND

The present invention generally relates to methods for dispensing premium items, specifically relates to methods for including flat premium items on the exterior of containers, and in the most preferred form relates to peel out portions incorporated in labels for containers including arcuate portions.

Due to the fierce competition in the marketing of products, it is the practice of many manufacturers to include a premium with the product to promote the sale of the product beyond the marketability of the product itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different types of packaging or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

One type of promotional devices which meet these requirements and which have had successful market acceptance are flat premium items like coupons or the like which are placed with the product and especially coupons which can be immediately redeemed to purchase the product.

One type of product for which immediately redeemed coupons has posed a particular problem is rigid containers formed of plastic, metal, glass, or the like and having a label formed from a single thickness of material such as paper attached thereto. One approach is to attach the releasable coupon by a low strength or peelable adhesive to the label referred to in the trade as "overlabeling". It can be appreciated that if the releasable coupon was attempted to be attached to the label before it is attached to the container, problems resulted in the label application machinery as the labels did not lie flat in the magazine but bulged therein due to the increased thickness of the releasable coupons (which was amplied due to the large number of labels which are stacked in the magazine) and as the releasable coupons tended to catch in the packaging machinery resulting in the releasable coupons being partially or totally removed from the label. Thus, a preferred method was to apply the releasable coupons to the labels after the labels are attached to the containers. For placement by mechanical means, this involved an another piece of equipment in the packaging operation which is undesirable at least due to reduction in line efficiencies. Additionally, such equipment generally did not successfully apply releasable coupons to every labeled container but rather a certain number of the containers did not include a releasable coupon. Additionally and especially for cylindrical containers having circular cross sections, the position of the containers and of the labels thereon are not uniform in the releasable coupon applying equipment so that the releasable coupons are randomly positioned in both horizontal and vertical axes on the labels of the containers.

It can then be appreciated that customer dissatisfaction and complaints can arise if advertising promotions and/or the printing located on the exterior of the product indicates that a promotional device is present when in fact for that particular product purchased, the promotional device was omitted for whatever reason. Likewise, the promotional device can be positioned on the product in a manner which potentially obstructs or otherwise interferes with the desired aesthetic appearance of the product to the customer. In fact, such causes of customer dissatisfaction may actually reduce the marketability of the product if occurring frequently. It can then be appreciated that promotional devices can be placed with the product manually. Although greatly reducing the chance of omission or misplacement of the promotional devices, such manual placement is relatively expensive in both the labor required but also in the disruption of the normal handling of the product. Automatic placement by mechanical means is less costly in both labor and disruption of normal handling, but typically increases the possibility of omission or misplacement of the promotional device with the product.

Another approach to solve the problem of providing immediately redeemable coupons for labeled containers is to incorporate the coupon in the label itself. This avoids the problems associated with the attachment of the releasable coupons to labeled containers. However, labels including incorporated coupons encountered other problems and in the past have not achieved significant market success. As an example, U.S. Pat. No. 5,484,167 shows a coupon formed into a label which was removed by pulling in a direction generally perpendicular to the axis and generally parallel to the circumference of the container. However, it should be appreciated that cuts which are oriented generally parallel to the axis of the container tend to flag outwardly due to the curvature of the container to which the label is applied. This flagging often results in the coupon being partially or completely torn from the label during the label application or during later packaging operations and thus resulting in an unsaleable product.

In an attempt to overcome this natural flagging occurrence, the cuts which are oriented generally parallel to the axis of the container and generally perpendicular to the tearing direction were formed by relatively coarse perforations and/or by complex perforations such as perforations which are not along a straight line and which were difficult to tear. This is undesirable for several reasons. First, such coarse and/or complex perforations resulted in large fragmentations and/or relatively rough edges on the releasable coupon. Thus, the coupon was unsightly to the consumer and difficult to handle for retail personnel and in redemption processing. Additionally and especially for annular labels which are secured to the container only at their overlap, there is a large tendency to tear the releasable coupon and/or for the label to tear completely especially between the upper and lower edges of the label and the coupon. Thus, the remaining portion of the label was unsightly and had a large tendency to be completely removed from the container so that identification of product inside nontransparent containers may not be readily available.

Thus, a need continues to exist to provide flat premium items on the exterior of labeled containers which overcome the problems and deficiencies of prior approaches to solve this need. In preferred aspects, it is especially desirable to incorporate the flat premium item into the label itself in a manner which is transparent to all packaging operations and which overcomes problems and deficiencies associated with prior labels including incorporated coupons.

It is thus an object of the present invention to provide novel methods for dispensing promotional devices with products.

Yet another object of the present invention is to provide such novel promotional device dispensing methods for flat premium items such as coupons on the exterior of containers.

Yet another object of the present invention is to provide such novel promotional device dispensing methods for flat premium items such as coupons on the exterior of containers including arcuate portions.

It is still further an object of the present invention to provide such novel flat premium dispensing methods incorporating peel out portions in labels for containers.

It is still further an object of the present invention to provide such a novel label including an incorporated peel out portion which is transparent to all packaging operations.

It is still further an object of the present invention to provide such a novel label including an incorporated peel out portion which is removed by pulling in a direction parallel to the axis of the container.

It is still further an object of the present invention to provide such a novel label including an incorporated peel out portion which does not include large fragmentations or relatively rough edges when removed from the remaining portions of the label.

It is still further an object of the present invention to provide such a novel label including an incorporated peel out portion which substantially eliminates undesired tearing of the label and the peel out portion during removal of the peel out portion.

It is still further an object of the present invention to provide such a novel label including an incorporated peel out portion which is relatively easy to tear from the label.

SUMMARY

Surprisingly, the above need, objects and other aims can be satisfied in the field of the dispensing of flat promotional devices in labeled containers by providing, in a preferred form of the present invention, a peel out portion incorporated in a label body formed of a single thickness of material and including a top cut in the label body spaced from the label edges and of a wedge shape including a high point and first and second ends with the high point located intermediate the ends of the top cut and located between the ends of the top cut and the label upper edge, with the top cut having an increasing size from the high point to the ends, with the peel out portion further including first and second side cuts extending from the first and second ends of the top cut in a direction generally parallel to the axis, with the peel out portion being releasable from the body by pulling the top cut adjacent to the high point in a direction towards the side cuts and generally parallel to the axis of the container to which the label body is adapted to be attached.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
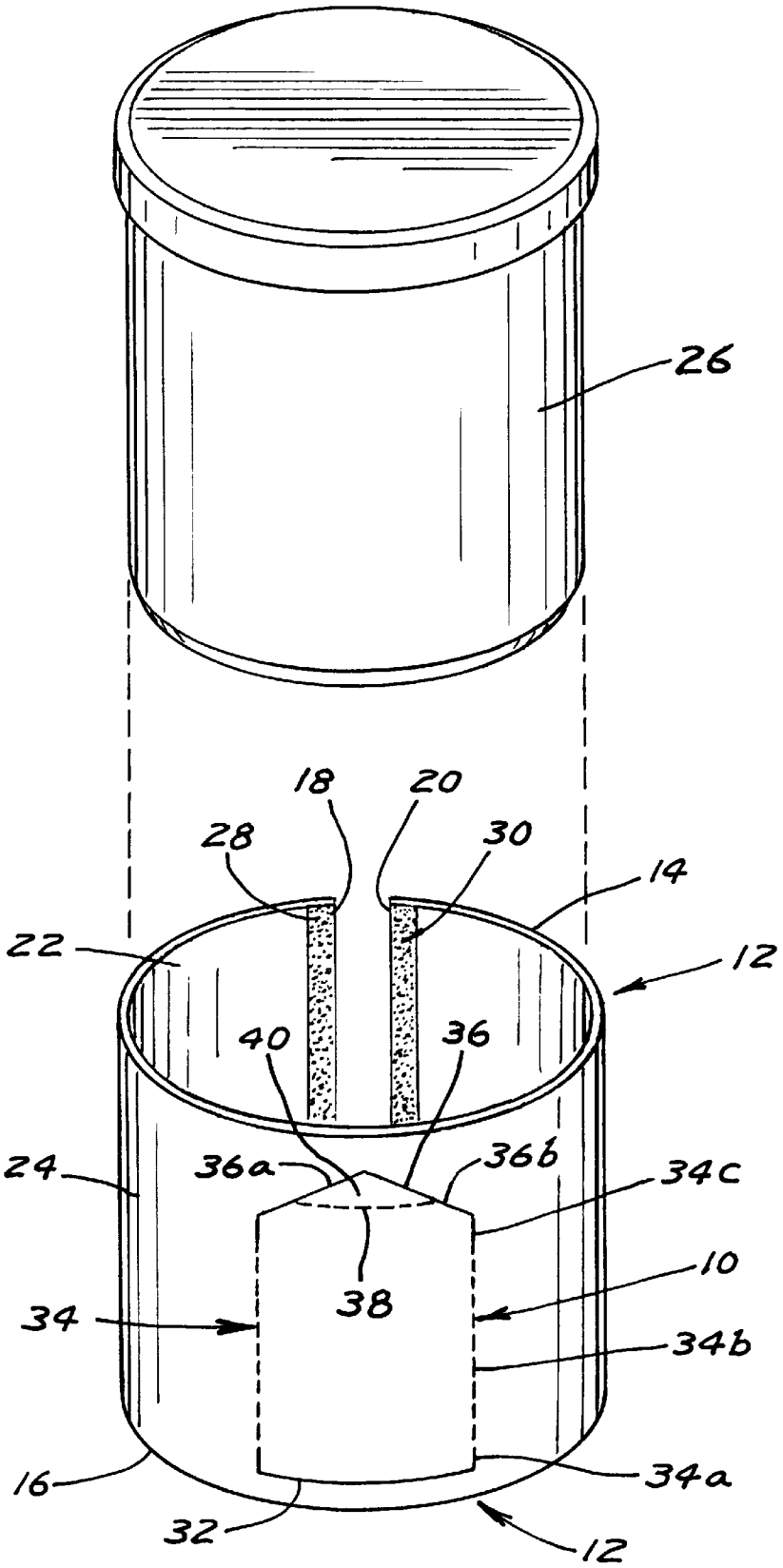
FIG. 1 shows an exploded perspective view of a cylindrical container and a label therefor having a peel out portion incorporated therein according to the teachings of the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "upper", "lower", "height", "width", "length", "end", "inner", "outer", "side", "horizontal", "vertical", "axis" and similar terms are used herein, it should be understood that these terms have reference only to the structure shown in the drawings as it would appear to a person viewing the drawings and are utilized only to facilitate describing the illustrative embodiment.

DESCRIPTION

A peel out portion incorporated into a paper label for a container including arcuate portions according to the preferred teachings of the present invention is shown in the drawings and generally designated 10. Label 12 is a body formed of a single thickness of material which can be wrapped around containers and at least the arcuate portions thereof and in the preferred form is formed of paper and in the most preferred form from 70 pound (31 kg) per 3000 square feet (186 square meters), one sided clay coated paper. However, label 12 could be formed of different weight paper and other single thickness materials such as plastic.

In the most preferred form shown, label 12 is generally rectangular shaped and includes an upper edge 14, a lower edge 16, a first end edge 18, a second end edge 20, an inner face 22, and an outer face 24. Container 26 in the preferred form shown is cylindrical in shape having circular cross sections and a height generally equal to but slightly less than the distance between edges 14 and 16 and a circumference or periphery of a length generally equal to but slightly less than the distance between edges 20 and 24. In the most preferred form, label 12 is attached to container 26 by conventional manners by conventional packaging machinery. Specifically, in the preferred form shown, adhesive 28 is applied to inner face 22 as a strip adjacent to edge 18 for securement to container 26 and then label 12 is wrapped around container 26 as a result of the rotation of container 26, with edge 20 overlapping and extending beyond edge 18. Adhesive 30 applied to inner face 22 as a strip adjacent to edge 20 secures to outer face 24 to form label 12 into an annular shape extending tightly around container 26 and possibly also secures to container 26 in front of edge 18.

Peel out portion 10 includes a bottom cut 32 which defines the bottom edge of peel out portion 10 in the preferred form.

Cut 32 is continuously die cut entirely through label 12 along its entire length between its first and second ends. Bottom edge 32 is spaced from edges 14, 16, 18 and 20 and is adjacent to lower edge 16. In the most preferred form, edge 32 is linearly straight and is parallel to lower edge 16.

Peel out portion 10 further includes first and second side cuts 34 which define the side edges 34 of peel out portion 10 in the preferred form. Cuts 34 extend from and terminate in the first and second ends of bottom edge 32, with edges 34 extending in a direction generally parallel to the axis of container 26 and spaced from edges 14, 16, 18 and 20. In the most preferred form, side edges 34 are linearly straight and are in a spaced parallel relation to each other and extend generally perpendicular relative to bottom edge 32. Side edges 34 each includes a lower portion 34*a* interconnected to bottom edge 32 which is continuously die cut entirely through label 12 along its entire length from the ends of bottom edge 32 which in the preferred form is about one eighth inch (3 mm).

Each side edge 34 further includes an intermediate, perforated portion 34*b* extending contiguously from lower portion 34*a*. Perforated portions 34*b* include segments die cut entirely through label 12 intermediate segments which are not cut through label 12 to thereby form perforations. In the most preferred form, perforated portions 34*b* are cut by knives including 70 equally sized and spaced teeth per inch (2.5 cm), with a greater number of teeth creating perforated portions 34*b* which are too fragile but numbers of teeth in the order of 50 per inch (2.5 cm) or less creating perforated portions 34*b* which are too difficult to tear in the most preferred form.

Each side edge 34 further includes an upper portion 34*c* extending contiguously from perforated portion 34*b*. Upper portions 34*c* are continuously die cut entirely through label 12 along their entire length from perforated portions 34*b*. In the preferred form, the length of upper portions 34*c* is generally 15% of the total length of side edges 32 which in the most preferred form is in the order of ⅜ inch (0.95 cm).

Figure 2:
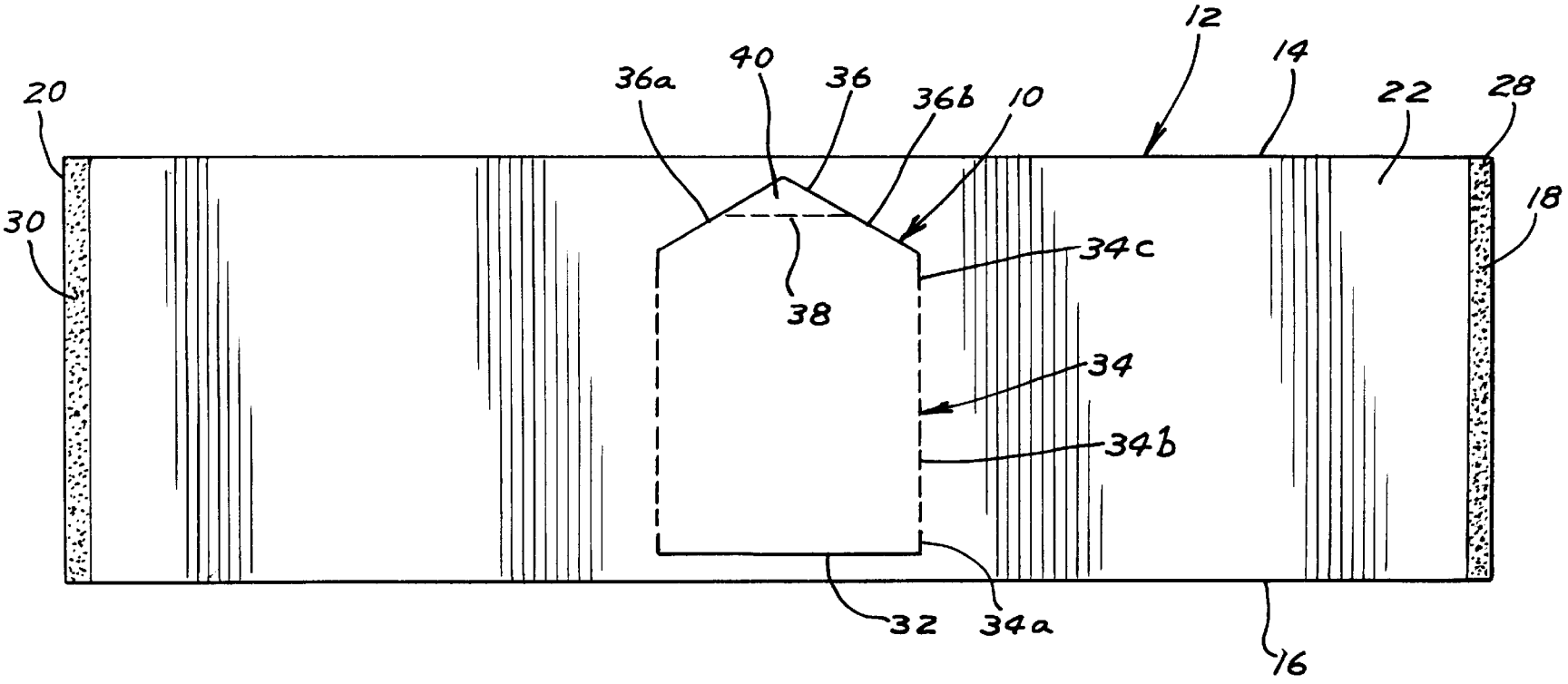
FIG. 2 shows a plan view of the label having a peel out portion incorporated therein of FIG. 1.

Peel out portion 10 further includes a top cut 36 which defines the top edge 36 of peel out portion 10 in the preferred form shown in FIGS. 1 and 2. Cut 36 has first and second ends extending from and interconnected to the upper portions 34*a* of side edges 34. Top edge 36 is wedge shaped of an increasing size from the high point to the first and second ends of edge 36. In the most preferred form, top edge 36 is formed by first and second straight linear portions 36*a* and 36*b* which intersect at the high point at a relatively large obtuse angle in the order of 125°. Thus, linear portions 36*a* and 36*b* are interconnected to upper portions 34*c* at an obtuse angle in the order of 120°. The center and high point of top edge 36 is located intermediate the ends of top edge 36 and is located between the first and second ends of top edge 36 and upper edge 14. Top edge 36 is continuously die cut entirely through label 12 along its entire length from the high point to the first and second ends, is spaced from edges 14, 16, 18 and 20, and is adjacent to upper edge 14.

In preferred forms of label 12 according to the teachings of the present invention and shown in FIGS. 1–4, peel out portion 10 further includes a perforated cut 38 extending perpendicular to the axis of container 26 and parallel to and spaced from upper edge 14 and located between the high point and the first and second ends of top edge 36. Perforated cut 38 intersects top edge 36 and in the most preferred form terminates in linear portions 36*a* and 36*b*. Perforated cut 38 is cut by a knife including teeth in a number which does not result in undesired tearing therealong but which is sufficient to define a fold line and in the most preferred form including 50 equally sized and spaced teeth per inch (2.5 cm).

In the most preferred form, peel out portion 10 is preferably symmetrical about an axial line extending parallel to the axis of container 26 and generally perpendicular between edges 14 and 16 and the interconnection between linear portions 36*a* and 36*b* of top edge 36. Additionally, first and second edges 34 are equally spaced from end edges 18 and 20, respectively, so peel out portion 10 is directly opposite or in other words 180° out of phase with edges 18 and 20 when label 12 is adhered to container 26. In less preferred embodiments, peel out portion 10 could be positioned offset from intermediate edges 18 and 20 with positioning peel out portion 10 offset towards edge 20 being more desireable than being offset towards edge 18.

Now that the basic construction of label 12 including peel out portion 10 according to the preferred teachings of the present invention has been set forth, a preferred mode of use of label 12 including peel out portion 10 can be explained and some of the advantages obtained thereby can be highlighted. In the preferred form, peel out portion 10 functions as a coupon and in the most preferred form is intended to be removed by the consumer at the cash register for use in the purchase of container 26 including label 12 having peel out portion 10. However, peel out portion 10 according to the teachings of the present invention may also be useful as a promotional or premium item. Labels 12 are printed on one or both of faces 22 and 24 and peel out portion 10 is die cut therein according to the teachings of the present invention. In this regard and especially for container 26 of a relatively short height, both faces 22 and 24 include printing within peel out portion 10, with face 24 typically including promotional information and instructions for removing peel out portion 10 from label 12 while adhered to container 26 and with face 22 including the bar code, instructions to the retailer for redemption, and like information.

After printing and die cutting, labels 12 are placed in the magazine of conventional label applying machinery. It should be appreciated that the die cuts and perforations forming peel out portion 10 result in a slightly greater thickness than the normal thickness of label 12. When stacked in the magazine, bulging of labels 12 will occur at the location of peel out portions 10. However, as no material is added to label 12, this bulging effect is minimized. Also, due to the placement of peel out portion 10 intermediate end edges 18 and 20, this bulging effect is generally in the center of the magazine which does not have as detrimental effect on the label application operation as when the bulging is at either end of the magazine resulting in labels 12 being angled in the magazine.

In typical, horizontal label application machinery, labels 12 are removed from the magazine by securement of label 12 adjacent to end edge 18 and being jerked or otherwise pulled from the magazine. It can then be appreciated that if peel out portion 10 is positioned adjacent to edge 18, tearing of the portions of label 12 intermediate edges 14 and 36 and intermediate edges 16 and 32 and along one or both of edges 34 can result and thereby resulting in the ripping of label 12. Thus, there must be at least a minimum expanse between end edge 18 and peel out portion 10 so as to provide label 12 with sufficient tensile strength to endure the label application operation. In this regard, placement of peel out portion 10 intermediate end edges 18 and 20 also results in label 12 having sufficient tensile strength.

After removal from the magazine, labels 12 are then applied by the label applying machinery in any conventional manner. In the preferred form shown, labels 12 would be applied by adhering adhesive 28 to the periphery of container 26, then wrapping label 12 around the circumference of container 26 typically by rotating container 26 relative to label 12, and then adhering adhesive 28 to the overlapped portion of label 12. It should be appreciated that adhesive 28 and 30 can be applied by the label applying machinery or can be applied to labels 12 before their placement in the magazine and activated in the label applying machinery. However, labels 12 can have other forms and can be applied in any other desired manners including but not limited to labels 12 having a length less the circumference of container 26. In any case, inner face 22 within peel out portion 10 should be free of adhesive.

Containers 26 including the applied labels 12 can then continue through conventional packaging operations including possibly being placed in further packaging and the like and retailed in manners which are conventional for such containers 26 with labels 12 not including peel out portions 10 of the present invention. If a consumer wished to purchase the product including container 26, the consumer would take container 26 to the cash register. In the most preferred form, the consumer would remove peel out portion 10 from label 12 while leaving the remaining portions of label 12 secured to container 26. The removed peel out portion 10 would then be given to the check out personnel and function as a coupon in reducing the purchase price of the product including container 26.

It should then be appreciated that peel out portion 10 according to the teachings of the present invention utilizes the curvature of container 26 to generally prevent undesired removal of peel out portion 10 from label 12 during label application, packaging, handling, and retailing of container 26. Specifically, peel out portion 10 has an orientation and is removed by pulling in a direction which is parallel to the axis of the curvature and not perpendicular thereto. In particular, the desired direction for pulling peel out portion 10 for releasing peel out portion 10 from label 12 is in a direction which is generally parallel to side edges 34 and parallel to the axis of the curvature of container 26 and particularly perpendicular to the circumferential direction of the curvature of container 26. In the most preferred form, the length of side edges 34 and especially the spacing of the high point of top edge 36 from bottom edge 32 are greater than the length of bottom edge 32. Although bottom edge 32 and top edge 36 are entirely cut, edges 32 and 36 do not have a tendency to flag out and in fact the arcuate shape of container 26 tends to hold edges 32 and 36 tightly against the periphery of container 26 due to the generally circumferential orientation of edges 32 and 36.

It should be further appreciated that the features which generally prevent undesired removal also makes desired removal of peel out portion 10 more difficult. Peel out portion 10 according to the preferred teachings of the present invention includes several features which counteract the use of the curvature of container 26 in retaining peel out portion 10 in label 12. In particular, portions 36*a* and 36*b* from their interconnection to perforated cut 38 and perforated cut 38 define a handle 40 which in the preferred form is triangular shaped due to the wedge shape of top edge 36. Due to the cut nature of portions 36*a* and 36*b* and the perforated nature of cut 38, handle 40 can be relatively easily pivoted relative to the remaining portions of peel out portion 10 about perforated cut 38 so that it can be grasped between the fingers of the consumer.

While grasping handle 40 adjacent to the high point of top edge 36 which in the preferred form shown in FIGS. 1 and 2 is at the interconnection of linear portions 36*a* and 36*b*, handle 40 can be pulled in a direction parallel to the axis of the curvature and generally closely adjacent to the periphery of container 26. Due to the curvature of peel out portion 10 and the periphery of container 26, it is necessary for peel out portion 10 to buckle adjacent its line of symmetry.

The tendency of peel out portion 10 or the remaining portions of label 12 to tear is virtually eliminated by a variety of features according to the preferred teachings of the present invention. Specifically, the wedge shape of top edge 36 tends to evenly distribute forces outward and simultaneously downward. Additionally, as portions 36*a* and 36*b* are continuously cut and particularly are not perforated, the forces required to remove top edge 36 are minimized. It can then be appreciated that as peel out portion 10 is pulled to the ends of portions 36*a* and 36*b*, the direction of movement changes from outward and downward to only downward. Thus, the continuously cut nature of upper portions 34*c* from the ends of top edge 36 to perforated portions 34*b* insures that peel out portion 10 or the remaining portions of label 12 are not torn at this transition. It should be appreciated that the ability of peel out portion 10 to buckle about its symmetry line without tearing is a function of the width between side edges 34 and the curvature of container 26. It has been found that a width between side edges 34 of about 2 inches (5 cm) can not extend through an arc greater than 60 degrees without tearing of labels 12 of the most preferred form.

After this transition and with handle 40 continuing to be pulled parallel to the axis of curvature of container 26, the portions between the perforations of perforated portion 34*b* are torn. Due to the very fragile perforated nature of portions 34*b* and since the force direction is parallel to portions 34*b* and particularly not of an increasing spacing, portions 34*b* can be uniformly and consistently torn. When the tearing reaches portions 34*a*, peel out portion 10 is free of attachment to label 12 and can be readily removed and separated from label 12 and container 26. Since tearing is in a single direction and due to the very fragile nature of perforated portions 34*b*, label 12 can be made from grain long paper and specifically without needing to use grain short paper even though peel out portion 10 and the tearing direction is vertically oriented.

It should be noted that the cut nature of bottom edge 32 does not require the consumer to change the direction of tearing from edges 34 to edge 32 as would be required if bottom edge 32 were incompletely cut such as being perforated. Particularly, a consumer may have a tendency to simply pull handle 40 downward and tear label 12 beyond edges 34 and past bottom edge 32 to lower edge 16 rather than stopping movement parallel to edges 34 and then moving peel out portion 10 in a direction parallel to edge 32 and perpendicular to edges 34. Additionally, the cut nature of portions 34*a* generally prevents the tearing of side edges 34 from extending towards and intersecting with lower edge 16 even though bottom edge 32 is entirely cut. Thus, the remaining portions of label 12 are left intact and complete without tearing after peel out portion 10 has been released from label 12 according to the teachings of the present invention. Additionally, although it is desirable to position bottom edge 32 as close as possible to lower edge 16 to maximize the area of faces 22 and 24 especially for relatively axially short containers 26, it is also advantageous to space bottom edge 32 and lower portions 34*a* of side edges 34 a minimum distance sufficient to prevent undesired tearing from lower edge 16 to bottom edge 32 and/or side edges 34 and in the most preferred form in the order of one eighth inch (3 mm). Such tears can arise especially where label 12 is adhered only adjacent to edges 18 and 20 and especially when adhered spaced from side edges 34 due to forces encountered during the application of labels 12 or during normal handling of containers 26 during packaging, transport, and retailing. It can be appreciated that such tears are subject to flagging and being easily caught resulting in further undesired tearing of label 12 and/or peel out portion 10. As an example, a tear extending from lower edge 16 may have a tendency to curl at those points upon routine handling and can get hung up and cause further tearing such as when dropped into further packaging or the like.

It should also be appreciated that pull out portion 10 according to the teachings of the present invention after removal from label 12 has an extremely clean appearance and does not have fragmentation. Specifically, edges 32 and 36 and portions 34*a* and 34*c* are entirely die cut through label 12 and thus do not require tearing and do not leave a rough edge after removal. Portions 34*b* are linearly straight, are torn in a parallel direction, and are very fragile. Thus, even though torn, portions 34*b* do not result in large fragmentations or relatively rough edges. Further, due to the orientation parallel to the axis of container 26 when incorporated in label 12, pull out portion 10 according to the teachings of the present invention when released from label 12 tends to have a flat configuration which is easier to process than if arched which can be a problem if elongated in a direction perpendicular to the axis of container 26.

It should then be appreciated that the wedge shape of top edge 36 of peel out portion 10 is a function of two different and desired results. Specifically, it is desired that top edge 36 of peel out portion 10 have a flat profile to maximize the areas of faces 22 and 24 of pull out portion 10 so that the area of face 24 and/or face 22 is sufficient to meet coupon size guidelines for redemption processing. This is extremely important for labels 12 having relative short spacing between edges 14 and 16. Alternately, it is desired that top edge 36 of peel out portion 10 have a generally pointed profile to reduce the tendency of tearing of label 12 and/or pull out portion 10 from the buckling of pull out portion 10 during removal and/or during transition from edge 36 to edges 34 during removal. If the top edge 36 of peel out portion 10 has a profile which is too flat, peel out portion 10 will have a tendency to tear down the center rather than along side edges 34. In the preferred form, the angle between linear portions 36*a* and 36*b* can have a minimum size of 154° to maximize the areas of faces 22 and 24 and still substantially eliminate the tendency of tearing of peel out portion 10 and/or label 12 and a maximum size of 120° for acceptability of peel out portions 10 as a coupon in the redemption operation.

Figure 3:
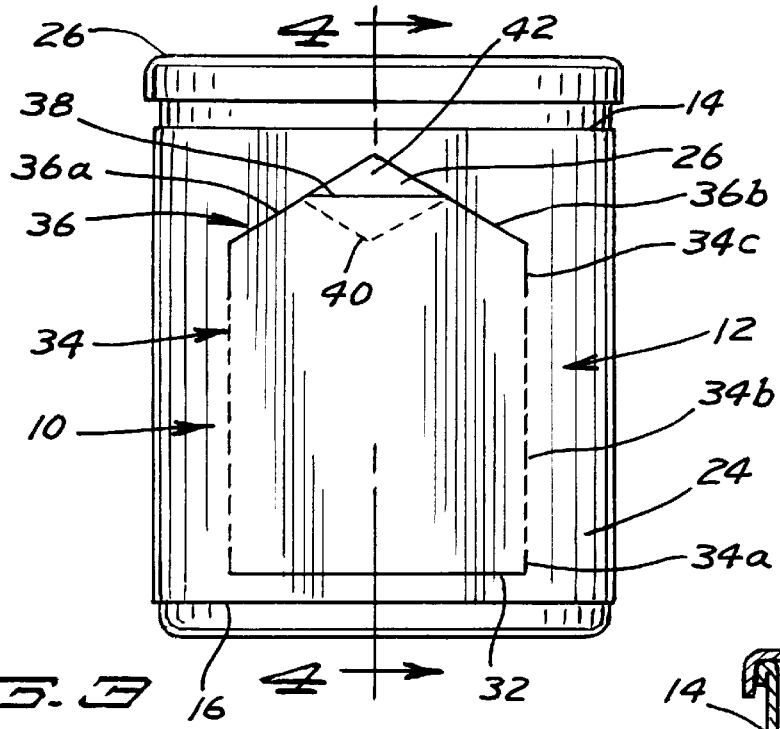
FIG. 3 shows a front view of an alternate embodiment of a label having a peel out portion incorporated therein attached to a cylindrical container according to the teachings of the present invention.
Figure 4:
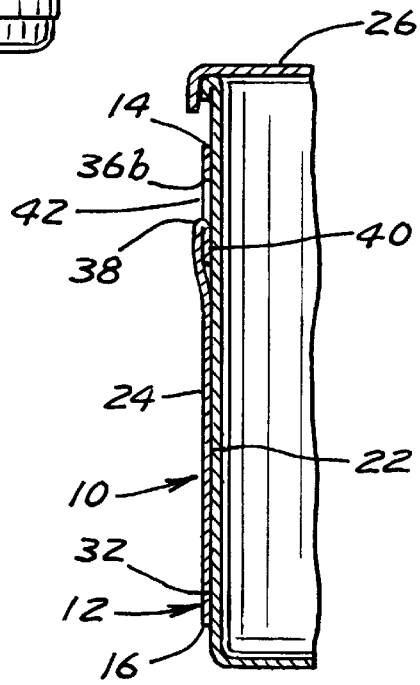
FIG. 4 shows a partial cross sectional view of the label, peel out portion, and container of FIG. 3 according to section line 4—4 of FIG. 3.

It should be further appreciated that the wedge shape of top edge 36 of peel out portion 10 can be formed by other manners and can be in other arrangements to enhance the ease of removal of peel out portion 10 from label 12 according to the teachings of the present invention. Specifically, in the form shown in FIGS. 1 and 2 and as described previously, inner face 22 and outer face 24 of handle 40 are generally coextensive with inner face 22 and outer face 24, respectively, of the remaining portions of peel out portion 10 and of label 12 when label 12 is attached to container 26. However, in alternate forms such as shown in FIGS. 3 and 4 and prior to the attachment of label 12 to container 26, handle 40 is pivoted and folded about perforated cut 38 such that inner face 22 of handle 40 flushly abuts with inner face 22 of peel out portion 10 when label 12 is attached to container 26. Thus, outer face 24 of handle 40 flushly abuts with container 26, and handle 40 is sandwiched between container 26 and peel out portion 10. Additionally, when attached to container 26 with handle 40 sandwiched between container 26 and peel out portion 10, an opening 42 is defined by portions 36*a* and 36*b* and cut 38 of an area corresponding to that of handle 40 and through which the periphery of container 26 is visible. It should be appreciated that top edge 36 of peel out portion 10 is wedge shaped and defined by portions 36*a* and 36*b* and cut 38 with the high point of top edge 36 of peel out portion 10 located on and extending along cut 38.

With handle 40 sandwiched between container 26 and peel out portion 10, a fingernail or fingertip can be inserted into opening 42 for pulling cut 38 of top edge 36 of peel out portion 10 inside of opening 42 away from container 26 so that peel out portion 10 adjacent to top edge 36 can be grasped between the fingers of the consumer and pulled in a direction parallel the axis of the curvature. Thus, peel out portion 10 can be removed from label 12 in a similar manner as when handle 40 is grasped and pulled. It should be appreciated that the sandwiching of handle 40 against container 26 causes the top edge 36 defined by cut 38 inside of opening 42 to have a double thickness which is easier to pull outward away from container 26 by a fingernail or fingertip.

Figure 5:
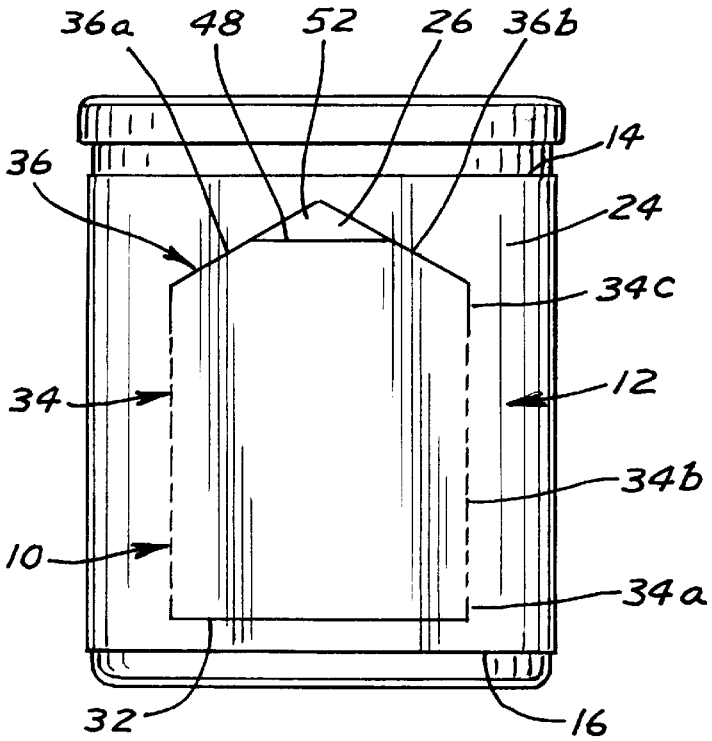
FIG. 5 shows a front view of a further alternate embodiment of a label having a peel out portion incorporated therein attached to a cylidrical container according to the teachings of the present invention.

In other forms such as shown in FIG. 5, peel out portion 10 includes a continuous die cut 48 extending generally perpendicular to the axis of the container 26 and parallel to and spaced from upper edge 14 and located between the interconnection of linear portions 36*a* and 36*b* and the first and second ends of top edge 36. An opening 52 is defined by and between portions 36*a* and 36*b* and cut 138 and through which the periphery of container 26 is visible. It should be appreciated that top edge 36 of peel out portion 10 is wedge shaped and defined by portions 36*a* and 36*b* and cut 48 with the high point of top edge 36 of peel out portion 10 located on and extending along cut 48. Thus, a fingernail or fingertip can be inserted into opening 52 for pulling cut 48 of top edge 36 of peel out portion 10 inside of opening 52 away from container 26 so that peel out portion 10 adjacent to top edge 36 can be grasped between the fingers of the consumer and pulled in a direction parallel to the axis of the curvature. Thus, peel out portion 10 can be removed from label 12 in a similar manner as when handle 40 is grasped and pulled and/or when top edge 36 of peel out portion 10 is grasped when a fingernail or fingertip is inserted into opening 42.

In further forms, the wedge shape of top edge 36 of peel out portion 10 can have other profiles than as shown in the drawings. As examples, cut 48 could be formed of linear portions similar to linear portions 36*a* and 36*b* but with the linear portions of cut 48 being at a larger angle than the angle between linear portions 36*a* and 36*b*. The free ends of the linear portions forming cut 48 could intersect with linear portions 36*a* and 36*b* at the first and second ends of top edge 36 or intermediate the free ends and the interconnection of linear portions 36*a* and 36*b*. Likewise, cut 48 could have an arcuate shape from its intersection with linear portions 36*a* and 36*b*. Further, linear portions 36*a* and 36*b* could terminate in cut 48 so that the area in label 12 above cut 48 is integrally secured to label 12 and does not form opening 52 in a manner as shown in FIG. 5. Thus, viewing of the periphery of container 26 would not be allowed with peel out portion 10 in place in label 12 in a similar manner as the embodiment of FIGS. 1 and 2. Although the variations have been disclosed with the embodiment of FIG. 5, similar and other variations are possible for the embodiments of FIGS. 1–4.

Now that the basic teachings of the present invention have been explained, other extensions and variations will be obvious to one having ordinary skill in the art. For example, although pull out portion 10 includes several features in combination believed to produce synergistic results, it can be appreciated that pull out portion 10 can be incorporated into label 12 according to the teachings of the present invention including such features individually in other combinations.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Label for a container having at least a portion which is arcuate in shape about an axis comprising, in combination: a body formed of a single thickness of material and adapted for attachment to the container and including an upper edge, a lower edge, and first and second end edges; and a peel out portion incorporated in the body including a top cut in the body spaced from the edges and of a wedge shape including a center point and first and second ends with the center point located intermediate the ends of the top cut and located between the ends of the top cut and the upper edge, with the top cut having an increasing size from the center point to the ends, with the peel out portion further including first and second side cuts extending from the first and second ends of the top cut in a direction generally parallel to the axis for substantially an entire length of the of the first and second side cuts, with the peel out portion being releasable from the body by pulling the top cut adjacent to the center point in a direction generally parallel to the axis and toward the side cuts.

2. The label of claim 1 further comprising, in combination: a perforated cut extending generally perpendicular to the axis and intersecting the top cut, with the perforated cut located between the center point and the first and second ends, with the top cut being continuously cut entirely through the body at least from the center point to the perforated cut defining a handle pivotable about the perforated cut.

3. The label of claim 2 wherein the top cut is continuously cut entirely through the body from the center point to the first and second ends.

4. The label of claim 3 wherein the top cut includes first and second linear portions interconnected at the center point at an angle.

5. The label of claim 4 wherein the angle of the linear portions is in the order of 125°.

6. The label of claim 3 wherein the side cuts each includes an upper portion interconnected to the end of the top cut and includes a perforated portion extending contiguously from the upper portion, with the upper portions being continuously cut entirely through the body from the ends of the top cut to the perforated portion.

7. The label of claim 6 wherein the upper portions extend generally 15% of the side cuts.

8. The label of claim 6 wherein the peel out portion further includes a bottom cut in the body spaced from the edges and including first and second ends, with the first and second side cuts terminating in the first and second ends of the bottom cut.

9. The label of claim 8 wherein the bottom cut is continuously cut entirely through the body between the first and second ends of the bottom cut.

10. The label of claim 9 wherein the side cuts each further include a lower portion extending contiguously from the perforated portion to the ends of the bottom cut, with the lower portions being continuously cut entirely through the body from the perforated portions to the ends of the bottom cut.

11. The label of claim 10 wherein the bottom cut is linearly straight.

12. The label of claim 11 wherein the side cuts are linearly straight and extend generally perpendicular to the bottom cut.

13. The label of claim 1 wherein the side cuts are linearly straight.

14. The label of claim 1 for the container including a periphery having a length; and wherein the first and second end edges are spaced a distance generally equal to but slightly greater than the length of the periphery.

15. The label of claim 14 further comprising, in combination: means for attaching the body to the container while leaving the peel out portion free for removal from the body.

16. The label of claim 15 wherein the body includes an inner face; and wherein the means for attaching the body are located as strips on the inner face adjacent to the first and second end edges.

17. The label of claim 15 wherein the peel out portion is located intermediate the first and second end edges.

18. The label of claim 1 wherein the top cut is continuously cut entirely through the body from the center point to the first and second ends.

19. The label of claim 18 wherein the side cuts each includes an upper portion interconnected to the end of the top cut and includes a perforated portion extending contiguously from the upper portion, with the upper portions being continuously cut entirely through the body from the ends of the top cut to the perforated portion.

20. The label of claim 19 wherein the peel out portion further includes a bottom cut in the body spaced from the edges and including first and second ends, with the first and second side cuts terminating in the first and second ends of the bottom cut, with the bottom cut being continuously cut entirely through the body between the first and second ends of the bottom cut, with the side cuts each further include a lower portion extending contiguously from the perforated portion to the ends of the bottom cut, with the lower portions being continuously cut entirely through the body from the perforated portions to the ends of the bottom cut.

21. The label of claim 1 further comprising, in combination: an opening formed in the body above the top cut adapted to allow insertion of a fingernail or fingertip.

22. The label of claim 21 further comprising, in combination: a fold line in the body and intersecting with the top cut to define a handle, with the handle and the peel out portion including an inner face, with the handle adapted to be folded about the fold line so that the inner face of the handle abuts with the inner face of the peel out portion.

23. Method comprising the steps of: providing a body formed of a single thickness of material and including an upper edge, a lower edge, and first and second end edges; continuously cutting a top cut entirely through the body spaced from the edges and of a wedge shape including a center point and first and second ends with the center point located intermediate the ends of the top cut and located between the ends of the top cut and the upper edge, with the top cut having an increasing size from the center point to the ends; and cutting first and second side cuts extending in a spaced parallel relation to each other and from the first and second ends of the top cut, with the side cuts including segments which are not cut through the body, with the top cut and the side cuts forming a peel out portion which is releasable from the body by pulling the top cut adjacent to the center point in a direction generally parallel to and toward the side cuts.

24. The method of claim 23 further comprising the steps of: providing a container having at least a portion which is arcuate in shape about an axis; and attaching the body to the container while leaving the peel out portion free for removal from the body and with the side cuts extending in a direction generally parallel to the axis.

25. The method of claim 24 wherein the container providing step comprises the step of providing the container including a periphery having a length; wherein the body providing step comprises the step of providing the body having the first and second end edges spaced a distance generally equal to but slightly greater than the length of the periphery; and wherein the attaching step comprises the steps of wrapping the label around the periphery of the container with the second end edge overlapping the first end edge in an overlapped portion, and adhering the body together in the overlapped portion to form an annular shape.

26. The method of claim 25 further comprising the step of: cutting a bottom cut in the body spaced from the edges and including first and second ends; and wherein the side cuts cutting step comprises the step of cutting the first and second side cuts terminating in the first and second ends of the bottom cut.

* * * * *